United States Patent [19]

Maric

[11] Patent Number: 4,989,840

[45] Date of Patent: Feb. 5, 1991

[54] CONTROLLING HIGH HUMIDITY ATMOSPHERES IN FURNACE MAIN BODY

[75] Inventor: Radovan R. Maric, Willowdale, Canada

[73] Assignee: Union Carbide Canada Limited, Toronto, Canada

[21] Appl. No.: 433,560

[22] Filed: Nov. 8, 1989

[51] Int. Cl.[5] ..... C23C 11/00

[52] U.S. Cl. ..... 266/111; 148/16; 148/16.5; 148/13.2

[58] Field of Search ..... 266/111; 148/16, 16.5, 148/13.2

[56] References Cited

U.S. PATENT DOCUMENTS

| | | | |
|---|---|---|---|
| 3,486,697 | 12/1969 | Fraser | 239/136 |
| 3,721,431 | 3/1973 | Nishida | 266/108 |
| 3,801,380 | 4/1974 | Ebner | 148/13.2 |
| 3,830,478 | 8/1974 | Pietroni | 266/104 |
| 3,925,109 | 12/1975 | Nilsen | 148/16.5 |
| 4,034,203 | 7/1977 | Cooper | 239/136 |
| 4,317,687 | 3/1982 | Kaspersma et al. | 148/20.3 |
| 4,472,209 | 9/1984 | Laengerich et al. | 148/13 |
| 4,547,228 | 10/1985 | Girell et al. | 148/16 |
| 4,632,707 | 12/1986 | Shay et al. | 148/16.5 |

*Primary Examiner*—Upendra Roy
*Attorney, Agent, or Firm*—Sim & McBurney

[57] ABSTRACT

The humidity of the atmosphere of a heat-treating furnace is controlled by the use of superheated steam, which is generated by the use of a furnace-heated humidifier to which water is fed through a capillary tube. A secondary gas flow passes through the humidifier and is humidified by the superheated steam. The humidified secondary gas flow then passes to a primary gas flow to be mixed therewith, before the primary gas flow passes to the furnace atmosphere.

11 Claims, 1 Drawing Sheet

CONTROLLING HIGH HUMIDITY ATMOSPHERES IN FURNACE MAIN BODY

FIELD OF INVENTION

The present invention relates to humidifying gas atmospheres and, in particular, to novel equipment for such purpose.

BACKGROUND TO THE INVENTION

Furnaces of various designs for heating steel parts and components employ atmospheres chiefly composed of nitrogen and carbon compounds, so that specific qualities, such as hardness and ductility, can be achieved.

Traditionally, heat-treating furnace atmospheres were obtained from endothermic generators, which employ natural gas and produce atmospheres of various humidity levels, dependent upon combustion and outdoor atmospheric conditions. Often, dryers are employed to control excess humidity.

More recently, endothermic generators have been replaced by systems utilizing gaseous flows of nitrogen and methanol from stored sources, the required flows being controlled by flow control panels.

Heat treating processes, such as annealing, require dry atmospheres (corresponding to a dew point of approximately −10° to +10° F.) for which nitrogen/methanol atmospheres are ideally suited. However, some processes, such as copper coating on steel, require higher humidity atmospheres (corresponding to a dew point in the range of about +40° F.).

This requirement has led to a search for a system to introduce humidity while excluding oxygen, which is an undesired component in these processes. Various procedures are being utilized, for example, bubbling nitrogen through a packed wet column, so that nitrogen becomes humidified by picking up water. However, precise humidity levels are not easily maintained.

The present invention is directed towards the provision of an improved humidifying method and apparatus which enables furnace atmosphere humidity levels to be controlled and more precisely maintained. A search has been conducted in the facilities of the United States Patent and Trademark Office with respect to the invention and the following U.S. patents have been noted as the closest prior art:

| | |
|---|---|
| U.S. 3,486,697 | R. F. Fraser |
| 3,721,431 | Nishida |
| 3,801,380 | Ebner |
| 3,830,478 | Pietroni |
| 4,547,228 | Girrell et al |
| 4,632,707 | Shay et al |

The cited prior art describes a variety of annealing processes as well as procedures for humidifying the atmosphere employed in such annealing processes. In general, humidification is provided by steam. One problem with steam is that small amounts of steam contain only small amounts of heat and hence, upon mixing with a nitrogen feed stream, there is a tendency for the steam to condense out of the gas stream, thereby significantly decreasing its effectiveness.

SUMMARY OF INVENTION

In the present invention, superheated steam is used to humidify a secondary gas flow and then the secondary gas flow is mixed with the primary gas flow, so as to humidify the primary gas flow before the primary gas flow enters the atmosphere of the furnace.

Accordingly, the present invention provides a method of humidifying an atmosphere, usually the high temperature atmosphere of a heat-treating furnace, by a plurality of steps. A primary gas flow is provided to the atmosphere, which may have a variable composition, depending on the operations carried out in the furnace, and for a heat-treating furnace, often comprises nitrogen and methanol. A secondary gas flow also is provided communicating with the primary gas flow for introducing a humid gas stream to the primary gas flow. The secondary gas flow usually may be a gas stream of the same composition as the primary gas Flow but most conveniently has the compositions of one, usually the major one, of the gas streams which, in the case of the heat-treating furnace, is nitrogen. The secondary gas flow is employed as the vehicle for introducing humidity, in the form of superheated steam, to the primary gas flow.

A humidifying zone is provided through which the secondary gas flow passes to be humidified therein. The humidifying zone may take any convenient form which permits superheated steam to be generated from water fed thereto. The humidifying zone generally is in the form of an elongate enclosed tube. An inner surface of the humidifying zone is maintained at a temperature significantly in excess of 100° C., usually about 300° to about 1200° C. This temperature may be achieved most effectively by providing the enclosed tubular humidifying zone projecting into the furnace, so as to be heated to the furnace temperature, which usually is in the range of about 500° to about 1200° C. for heat treating, brazing, annealing or sintering parts and components. For other applications of the method, the provision of the required humidifying zone at the required temperature may be effected using an external heater.

The required quantity of water is fed onto the inner surface of the humidifying zone so as to be very rapidly heated by the hot surface and to generate superheated steam in the humidifying zone. In this way, the secondary gas flow passing through the humidifying zone is rapidly humidified. The secondary gas flow itself is heated as it passes through the humidifying zone and hence is enabled to better absorb and carry moisture. The secondary flow then is fed into the primary gas flow so as to mix with and humidify the primary gas flow, which passes thence to the furnace atmosphere.

The extent to which the secondary gas flow is humidified usually is controlled to meet the requirements of the furnace atmosphere. This control may be achieved in any convenient manner. One convenient procedure employs a metering valve which controls the flow rate of water to the humidifying zone. to correspond to the desired humidity level. In this way, the moisture content of the furnace atmosphere is controlled and more precisely maintained than is possible with the prior art.

The present invention also includes apparatus for carrying out the method of the invention, as described above. Such apparatus includes an elongate enclosed housing means and a one-piece water feed means extending from exterior to the housing means and through one end of the housing means to adjacent the other end. Control means is provided associated with the on-piece water feed means for controlling the flow of water therethrough and gas flow means is connected to the housing means for the flow of gas thereto and for the flow of, gas therefrom.

DESCRIPTION OF PREFERRED EMBODIMENT

Figure 1:
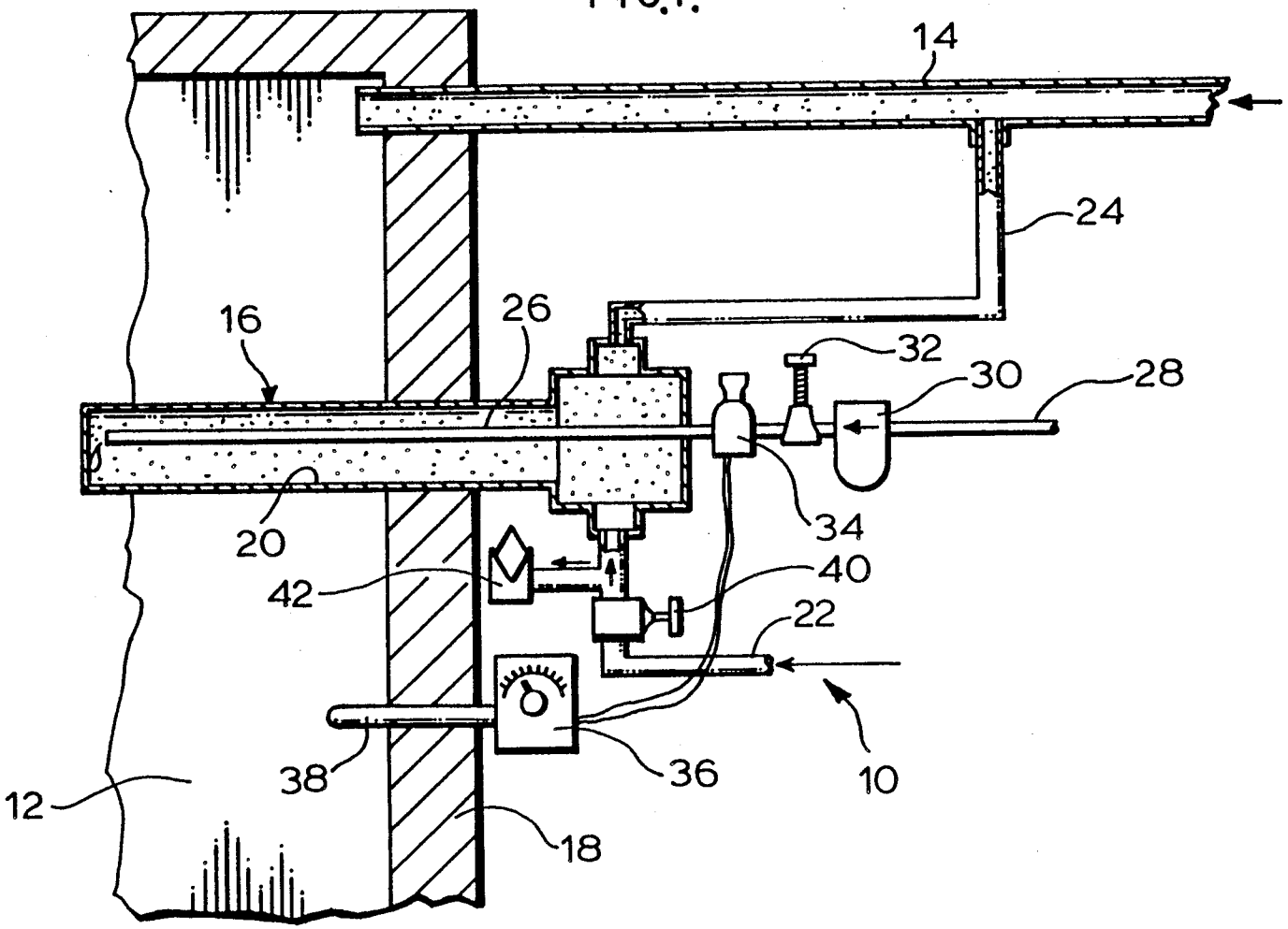
FIG. 1 is a schematic representation of a humidifying apparatus according to one embodiment of the invention for humidifying a furnace atmosphere.

Referring to the drawing, there is illustrated a humidifying apparatus 10 provided in association with a heat treating furnace 12, to which gases are fed to provide an atmosphere of controlled chemical composition and moisture content. While the humidifying apparatus 10 is shown in conjunction with a heat treating furnace 12, this arrangement is intended to be illustrative. It will be apparent to those skilled in the art that the humidifying apparatus may be employed to provide humidity for a variety of applications.

A primary gas flow line 14 is provided communicating with the atmosphere of the furnace 12 to provide a gas mixture of desired composition in the furnace atmosphere, for example, nitrogen and methanol.

An elongate enclosed tubular member 16 extends through a wall 18 of the furnace 12, so as to be exposed to the furnace atmosphere and to be heated thereby. Such means of heating again is illustrative and any other convenient heating means may be employed, such as an external heater.

The furnace 12 usually is at a considerable temperature so to effect the heat treatment therein, usually about 500° to about 1200° C. This arrangement consequently causes the portion of the tubular member 16 extending through the furnace wall 18 to be heated substantially to that temperature, which results in a very hot internal surface 20. The elongate tubular member 16 may be constructed of any convenient material to withstand the temperatures to which it is exposed. One material which may be used is stainless steel.

The elongate tubular member 16 communicates at the end opposite to that projecting through the furnace wall 18 with a secondary gas flow line 22, which passes a secondary flow of the furnace gas to the interior of the elongate tubular member 16, which functions as a humidifying zone for the secondary gas flow. The elongate tubular member 16 also communicates at the same end as secondary gas flow line 22 with the primary gas flow line 14 via a gas flow line 24, which usually is insulated to inhibit condensation of moisture therein, so that secondary gas flow may pass from the humidifying zone 16 to the primary gas flow line 14.

An elongate capillary tube 26, which also may be constructed of stainless steel, extends axially in the elongate member 16 from the end communicating with the secondary gas feed line 22 to adjacent the end located in the furnace 12, so that the open end of the capillary tube 26 is adjacent the heated surface 20. The capillary tube 26 communicates with a water feed line 28, so that water can be fed through the capillary tube 26 and into the humidifying zone 16.

A demineralizing filter 30 is provided in association with the water feed line 28 to avoid the build up of scale in the humidifying zone 16. A metering valve 32 is provided downstream of the demineralizing filter to provide for a manual control of the flow of water to the humidifying zone 16. A solenoid valve 34 is provided downstream of the metering valve 32 to provide an upper level humidity control with respect to the humidity of the humidifying zone 16. The valve 34 normally is closed, but is opened, as required, to permit water flow therethrough to maintain the desired humidity level.

The operation of the solenoid valve 34, is controlled by a humidistat 36, which has a probe 38 which passes through the furnace wall 18 to determine the humidity of the atmosphere in the furnace 12 on an ongoing basis. In the event that the humidity of the furnace atmosphere exceeding a predetermined maximum level, de-energizing the solenoid valve 34 closes it to stop water flow. Once the humidity level is restored below the predetermined maximum level, the valve 34 is opened and water flow resumes.

The secondary gas flow line 22 is provided with a regulatory and shut-off valve 40, which controls the flow rate of secondary gas flow to the humidifying zone 16. A pressure relief valve 42 also is provided in the secondary feed line, downstream of the valve 40, as a safety measure.

OPERATION

In operation, a metered flow of water controlled by the valve 32 and as determined by the required humidity of the atmosphere of the furnace, passes through a capillary tube 26 and is deposited as droplets on the inner heated surface 20. The very hot temperature of the surface causes an immediate formation of superheated steam which fills the internal cavity of the elongate member.

The secondary gas flow in line 22 passes into the humidifier 16, becomes heated by the hot internal environment and picks up moisture in the form of the superheated steam.

The humidified and heated secondary gas flow then passes by line 24 to the primary gas feed line 14, to mix with and humidify the primary gas feed in line 14 to the extent required by the atmosphere of the furnace 12. The pressure of the secondary gas flow usually is slightly greater than that of the primary gas flow to ensure that the flow and mixing occur.

Once stable atmosphere conditions are established in the furnace 12, the amount of water fed to the humidifying zone 16 can be precisely adjusted and maintained by the metering valve 32. The humidistat 36 then can be set to the upper level of humidity required, so as to prevent excessive humidity of the atmosphere in the furnace 12, by the mechanism discussed earlier.

SUMMARY OF DISCLOSURE

In summary of this disclosure, the present invention provides a novel humidifying method and apparatus which enables the humidity of an atmosphere, such as in a heat-treating furnace, to be closely controlled. Modifications are possible within the scope of this invention.

What I claim is:

1. A method of humidifying an atmosphere, which comprises;

feeding a primary gas flow to said atmosphere, feeding a secondary gas flow through a heated humidifying zone to be humidified therein by superheated steam, maintaining an inner surface of said humidifying zone at a temperature significantly in excess of 100° C. so as to heat said secondary gas flow therein and thereby increase the carrying capacity of said secondary gas flow for superheated steam, feeding water onto said inner surface of said humidifying zone to generate said superheated steam in said humidifying zone to humidify said secondary gas flow by said superheated steam in said humidifying zone simultaneously with said heating of said secondary gas flow, said feeding said humidified secondary gas flow into said primary gas flow to be mixed therewith prior to feed of said primary gas flow to said atmosphere, thereby humidifying said primary gas flow and hence said atmosphere.

2. The method of claim 1 wherein said secondary gas flow comprises a portion of the major component of a gas mixture used as said primary gas flow.

3. The method of claim 1 wherein said inner surface of humidifying zone is maintained at a temperature of about 300° to about 1200° C.

4. The method of claim 1 wherein said atmosphere is contained in a furnace, said humidifying zone is an elongate tubular housing and said inner surface of said humidifying zone is maintained at said temperature by projecting a portion of said tubular housing through a wall of said furnace so as to be in heat-exchange relationship with said furnace atmosphere.

5. The method of claim 2 wherein said primary gas flow is a mixture of nitrogen and methanol and said secondary gas flow is nitrogen.

6. The method of claim 3 wherein the humidity of said atmosphere is predetermined and the water is fed onto said inner surface of said humidifying zone at a rate such that the humidity introduced to said primary gas flow by the secondary gas flow and thereby said atmosphere is maintained substantially at said predetermined level.

7. The method of claim 4 wherein said furnace atmosphere has a temperature of about 500° to about 1200° C.

8. The method of claim 6 wherein the humidity of said atmosphere is continuously monitored and water feed to said inner surface of said humidifying zone is stopped in the event that the monitored humidity exceeds a predetermined maximum level.

9. The method of claim 7 wherein said water is fed through a capillary tube extending from external to said tubular housing and through one end of said tubular housing to the other end, so as to deposit a metered quantity of water on the inner surface of said humidifying zone adjacent said other end of the housing.

10. The method of claim 9 wherein the humidity of said furnace atmosphere is predetermined and the flow of water through said capillary tube is controlled so that water is fed onto the said inner surface of said humidifying zone at a rate such that the humidity introduced to said primary gas flow by the secondary gas flow and hence said furnace atmosphere is maintained substantially at said predetermined level.

11. The method of claim 10 wherein the humidity of the furnace atmosphere is monitored continuously by means generating an electrical signal in the event of the furnace atmosphere humidity exceeding a predetermined level and water flow on-off means actuable by a signal from said furnace atmosphere humidity monitor means to shut off water flow to said capillary tube means.

* * * * *